US005286422A

United States Patent [19]

Kato et al.

[11] Patent Number: 5,286,422

[45] Date of Patent: Feb. 15, 1994

[54] PROCESS FOR PRODUCING THREE-DIMENSIONAL FIBER USING A HALOGEN GROUP SOLVENT

[75] Inventors: Jinichiro Kato; Toshio Yoneyama, both of Nobeoka; Kazuhiko Shimura, Moriyama; Yoshiaki Nakayama; Kenji Kanekiyo, both of Nobeoka, all of Japan

[73] Assignee: Asahi Kasei Kogyo Kabushiki Kaisha, Osaka, Japan

[21] Appl. No.: 922,546

[22] Filed: Jul. 31, 1992

[30] Foreign Application Priority Data

| | | | |
|---|---|---|---|
| Aug. 3, 1991 | [JP] | Japan | 3-194551 |
| Nov. 5, 1991 | [JP] | Japan | 3-288682 |
| Nov. 5, 1991 | [JP] | Japan | 3-288766 |
| Jan. 14, 1992 | [JP] | Japan | 4-004780 |
| Jan. 14, 1992 | [JP] | Japan | 4-004936 |
| Jan. 14, 1992 | [JP] | Japan | 4-004938 |

[51] Int. Cl.[5] ..... D01D 5/11

[52] U.S. Cl. ..... 264/13; 264/177.13; 264/205; 264/211; 264/211.14

[58] Field of Search ..... 264/13, 177.13, 205, 264/211, 211.14

[56] References Cited

U.S. PATENT DOCUMENTS

| | | | |
|---|---|---|---|
| 3,081,519 | 3/1963 | Blades et al. | 57/248 |
| 3,227,784 | 1/1966 | Blades et al. | 264/205 X |
| 3,227,794 | 1/1966 | Anderson et al. | 264/205 |
| 3,467,744 | 9/1969 | Woodell | 264/205 |
| 3,564,088 | 2/1971 | Woodell | 264/205 |
| 3,756,441 | 9/1973 | Anderson et al. | 264/205 |
| 5,023,025 | 6/1991 | Shin | 264/13 |
| 5,032,326 | 7/1991 | Shin | 264/13 |
| 5,039,460 | 8/1991 | Shin | 264/13 |
| 5,081,177 | 1/1992 | Shin | 524/462 |
| 5,147,586 | 9/1992 | Shin et al. | 264/13 |

FOREIGN PATENT DOCUMENTS

| | | |
|---|---|---|
| 0285670A1 | 10/1988 | European Pat. Off. . |
| 0321567A1 | 6/1989 | European Pat. Off. . |
| 0357364A2 | 3/1990 | European Pat. Off. . |
| 357364A3 | 3/1990 | European Pat. Off. . |
| 357381A3 | 3/1990 | European Pat. Off. . |
| 0357381A2 | 3/1990 | European Pat. Off. . |
| 0361684A1 | 4/1990 | European Pat. Off. . |
| 381216A1 | 8/1990 | European Pat. Off. . |
| 0407953A2 | 1/1991 | European Pat. Off. . |
| 0414498A2 | 2/1991 | European Pat. Off. . |
| 0431801A2 | 6/1991 | European Pat. Off. . |
| 450854A3 | 11/1991 | European Pat. Off. . |
| 0482882A1 | 4/1992 | European Pat. Off. . |
| 40-28125 | 12/1965 | Japan . |
| 42-19520 | 10/1967 | Japan . |
| 62-33816(A) | 2/1987 | Japan . |
| 63-50512(A) | 3/1988 | Japan . |
| 2-139408 | 5/1990 | Japan . |
| 2-160909 | 6/1990 | Japan . |
| 3-76809 | 4/1991 | Japan . |
| 3-152209 | 6/1991 | Japan . |
| 3-206111 | 9/1991 | Japan . |
| 4-185708 | 7/1992 | Japan . |
| WO91/05082 | 4/1991 | PCT Int'l Appl. . |
| WO91/13193 | 9/1991 | PCT Int'l Appl. . |

OTHER PUBLICATIONS

Communication dated Jun. 16, 1993 from the European Patent Office in Application EP 92 30 7020.5; Supplementary European Search Report and Annex.

*Primary Examiner*—Leo B. Tentoni

*Attorney, Agent, or Firm*—Finnegan, Henderson, Farabow, Garrett, Dunner

[57] ABSTRACT

A halogen group solvent comprising a mixed solvent consisting essentially of bromochloromethane and/or 1,2-dichloroethylene and a co-solvent, wherein the co-solvent is at least one member selected from the group consisting of carbon dioxide, sulfur hexafluoride, difluorochloromethane, 1,1,1,2-tetrafluoroethane, etc., and the content of said co-solvent in the mixed solvent is 3 to 65% by weight; a polyolefin solution using the solvent; and a process for producing a three-dimensional fiber of a polyolefin using the solution.

9 Claims, 4 Drawing Sheets

BLEND RATIO : t-DCE/BCM/CO2 (wt%)

t-DCE : TRANS-1, 2-DICHLOROETHYLENE

BCM : BROMOCHLOROMETHANE

PROCESS FOR PRODUCING THREE-DIMENSIONAL FIBER USING A HALOGEN GROUP SOLVENT

BACKGROUND OF THE INVENTION

1. Field of the Invention

The present invention relates to an improved solvent having a low toxicity, a low combustibility and a low capability of depleting an ozonosphere and a polyolefin solution using said solvent. Further, the present invention provides a process for producing an improved process for producing a three-dimensional fiber of a polyolefin having an excellent strength and spreadability for use in an nonwoven fabric sheet through the use of said solvent and said solution.

Namely, the present invention relates to an improved solvent which is non-toxic and non-combustible and very safe when used, and a polyolefin solution and an improved flash spinning process using said solvent. The solvent according to the present invention can be applied not only to a polyolefin solution for flash spinning but also to a cleaning agent, a foaming material, a gas for the production of a hollow filament, and a reaction solvent, etc.

2. Description of the Related Art

A process for producing a polyolefin fiber having a plexifilamentary structure is known as a flash spinning process. The flash spinning process is a well known spinning process which comprises adding a polyolefin to an organic solvent also known as a liquefied gas, preparing a polyolefin solution under high temperature and high pressure conditions, passing the solution through a pressure let-down orifice to once lower the pressure of the solution to bring about a phase separation, and passing the opaque solution through a spinneret to inject the solution into an atmosphere where the temperature and pressure are room temperature and normal pressure, respectively, to thereby form a fiber having a three-dimensional structure.

This spinning process is described in, for example, U.S. Pat. No. 3081519, U.S. Pat. No. 3227794, U.S. Pat. No. 3227784, U.S. Pat. No. 3467744, U.S. Pat. No. 3564088 and U.S. Pat. No. 3756411, EP 285670 Al, EP 321567 Al, EP 357364 A2, Japanese Examined Patent Publication (Kokoku) No. 40-28125, Japanese Examined Patent Publication (Kokoku) No. 42-19520, Japanese Unexamined Patent Publication (Kokai) No. 62-33816 and Japanese Unexamined Patent Publication (Kokai) No. 63-50512.

The fiber prepared by this flash spinning process is classified into a short fiber-like material and a three-dimensional fiber material. The former is used as a synthetic pulp, and the latter is used as a nonwoven fabric sheet. The nonwoven fabric sheet is generally known as a synthetic paper. The largest feature of this product resides in a good water resistance, high strength and light weight, and freedom from fuzzing. This is highly appreciated in the art, and this nonwoven fabric is applied to envelopes for air mail, sleeves for floppy disks, bags for deoxidizers, bags for desiccants, medical sterilizing bags, clothes for preventing dewing caused by thermal insulation of buildings, working wear for working in nuclear power generation, working wear for asbestos, and working wear for safety and protection, etc. A three-dimensional fiber which has a high strength and is highly spreadable is indispensable to the production of products having these features. This is because a uniform sheet which is dense and permeable to air can not be produced without the use of such a fiber.

The above-described nonwoven fabric sheets based on a plexifilamentary polyolefin fiber are already commercially available as TYVEK® from DuPont in U.S.A., and LUXER® from the applicant of the present invention.

The solvent for the polymer used in the flash spinning process should have the following properties. This is also shown in U.S. Pat. No. 3081519. (1) The boiling point of the solvent is at least 25° C. below the melting point of the polymer used; (2) the solvent is inert to the polymer under spinning conditions; (3) the solvent is a good solvent for the polymer under temperature and pressure conditions suitable for the preparation of a polymer solution; (4) the solvent dissolves only 1% of the polymer when the temperature is below the boiling point of the solvent; and (5) the solvent can immediately give rise to a phase separation at the time of spinning to form a phase consisting essentially of a polymer, and the separated polymer phase is substantially free from the solvent.

Specific known examples of the solvent include aromatic hydrocarbons such as benzene, toluene, aliphatic hydrocarbons such as butane, pentane, hexane, heptane and octane and their isomers and homologues, alicyclic hydrocarbons such as cyclohexane, unsaturated hydrocarbons, halogenated hydrocarbons such as methylene chloride, carbon tetrachloride, chloroform, ethyl chloride and methyl chloride, alcohols such as ethanol, methanol and hexafluoroisopropanol, esters, ethers, ketones, nitriles, amides, fluorochlorinated aliphatic hydrocarbons such as trichlorofluoromethane, 1,1,2-trichloro-1,2,2-trifluoromethane, sulfur dioxide, carbon disulfide, nitromethane, water and various liquid mixtures of the above-described solvents.

An optimal solvent is properly selected from these solvents after various conditions for the spinning process used and the kind of polymers used are taken into consideration. Trichlorofluoromethane and 1,1,2-trichloro-1,2,2-trifluoroethane which has a high capability of dissolving the polymer and an excellent spinnability and are noncombustible and nontoxic are favorable as the solvent for the flash spinning process of a polyolefin. Among others, trichlorofluoromethane is the best solvent.

In the flash spinning, to inject a polymer solution under high temperature and high pressure into the air to gasify the solution, the solvent should have a low boiling point, remain undecomposed even at a high temperature, have a lipophilic property sufficient for dissolving the polyolefin, and have at least a low toxicity and be fire-resistant. Specifically, in the flash spinning, the solvent is gasified to separate the solvent from the polymer, and the gasified solvent is recovered and liquefied by compression with cooling. Therefore, the flash spinning is conducted in an extensive, sealed space. This is because a gasified solvent can not be recovered when the flash spinning is not conducted in such an extensive space. The size of the sealed space is, for example, as large as 2000 $M^3$. The filling of such an extensive space with a combustible gas increases the possibility of fire and explosion, and therefore is, very dangerous, which makes it substantially impossible to use a combustible gas as a solvent.

In general, a corona discharge device or a high-voltage destaticizer is contained in the sealed space and can be an ignition source of the combustible gas. This further makes the use of a combustible gas unfavorable. Further, various facilities such as a metallic conveyor for the formation of a nonwoven fabric, a corona discharge device and a spinning head are provided in the sealed space, and this makes it unavordalbe that workers must enter the sealed space for repair and maintenance work. Further, the outlet port for the formed nonwoven fabric sheet is non-contact sealed, and the gas within the sealed space always leaks into the work section. Therefore, when the solvent is toxic, it cannot be used as a solvent for flash spinning. For this reason, trichlorofluoromethane, which is noncombustible and nontoxic, has been regarded as the only solvent useable for the flash spinning process.

In recent years, however, it has been found that a wholly halogenated hydrocarbon wherein all the hydrogen atoms are substituted with chlorine and fluorine is a particular flon (chlorofluorocarbon also known as "CFC") having a very high capability of depleting ozonosphere. It has been decided that the production of a CFC be prohibited by A.D. 2000, from the viewpoint of a protection of the environment. It is a matter of course that the production of trichlorofluoromethane, 1,1,2-trichloro-1,2,2-trifluoroethane, etc. as particular flons also will be prohibited, and these flons become commercially unavailable. Therefore, trichlorofluoromethane will become unable to be utilized as a solvent in the flash spinning process of a polyolefin.

Under these circumstances, a flash spinning process wherein a new solvent is used without the use of trichlorofluoromethane as a particular flon has been already proposed.

Specifically, U.S. Pat. No. 5032326, EP 0357381A2 and Japanese Unexamined Patent Publication (Kokai) No. 2-139408 disclose a flash spinning process wherein use is made of a mixed solvent comprising methylene chloride and an alternative flon, for example, chlorofluoromethane, 1,1,1,2-tetrafluoroethane, 1,1-difluoroethane, 1,1,1,2-tetrafluoro-2-chloroethane or 1-chloro-1,1-difluoroethane. Further, U.S. Pat. No. 5081177, U.S. Pat. No. 5023025, EP 0 361684A1, Japanese Unexamined Patent Publication (Kokai) No. 2-160909 disclose a spinning process wherein use is made of 1,1-dichloro-2,2,2-trifluoroethane, 1,2-dichloro-1,2,2-trifluoroethane, 1,1-dichloro-2,2-difluoroethane, 1,2-dichloro-1,1-difluoroethane or 1,1-dichloro-1-fluoroethane. Further, EP 0407953A2 discloses a spinning process wherein 1,1-dichloro-2,2,2-trifluoroethane, 1,2-dichloro-1,2,2-trifluoroethane or the like is used as a solvent for polypropylene. Further, EP 357364A4 and Japanese Unexamined Patent Publication (Kokai) No. 3-76809 disclose a process wherein spinning is conducted through the use of methylene chloride and carbon dioxide. Further, EP 0414498A2 and Japanese Unexamined Patent Publication (Kokai) No. 3-152209 discloses a process wherein use is made of a mixed solvent comprising a water-containing organic solvent. Further, EP 431801 discloses a process wherein spinning is conducted through the use of carbon dioxide and water.

Japanese Unexamined Patent Publication (Kokai) No. 4-185708 discloses a spinning process using 1,1-dichloro-2,2,3,3,3-pentafluoropropane and/or 1,3-dichloro-1,2,2,3,3-pentafluoropropane mixed with hydrocarbon derivative.

All of the above-described proposed flash spinning processes, however, give rise to drawbacks when spinning is conducted through the use of a polyolefin.

For example, the mixed solvent comprising methylene chloride and an alternative flon proposed in U.S. Pat. No. 5032326 may be tentatively used as a solvent for use in a laboratory, but, it cannot be used as an industrial solvent. This is because methylene chloride is highly toxic and carcinogenic. TLV (threshold limit values of airbone contaminants) established by ACGIH (American Conference of Governmental Industrial Hygienists) is known as an index for indicating the degree of toxicity. The TLV of trichlorofluoromethane is 1000 ppm, but the TLV of methylene chloride is as low as 50 ppm. Therefore, it is apparent that methylene chloride has a higher toxicity than trichlorofluoromethane. Further, methylene chloride is registered as a carcinogenic substance. This clearly suggests that methylene chloride and its mixed solvent cannot be used on a commercial scale as a solvent for flash spinning. Further, the use of methylene chloride involves a problem from the viewpoint of properties required at the time of spinning. The reason for this is that the heat of evaporation of methylene chloride is 78.7 cal/g which is much larger than that of trichlorofluoromethane, i.e., 43.5 cal/g. This means that the use of methylene chloride as a solvent causes a spun yarn to be liable to be damped by the residual solvent. As described also in Japanese Unexamined Patent Publication (Kokai) No. 3-76809, the damped yarn is liable to adhere to and wind around a roller used for pressing the yarn into a sheet structure, so that a no nonwoven fabric sheet having a commercial value cannot be produced, which makes it impossible to produce the nonwoven fabric sheet on a commercial scale. For this reason, when methylene chloride is used as a solvent, it is necessary to allow a gas having a low boiling point to exist together with the methylene chloride solvent, for accelerating the evaporation of methylene chloride remaining in a fiber as spun, and at the same time, to previously enhance the polymer concentration of a spinning solution. The enhancement of the polymer concentration is effective for increasing the amount of occurrence of heat of solidification at the time of flashing of the polymer solution to accelerate the drying of a spun yarn through the utilization of the heat. In this case, the yarn becomes damped when either the use of a gas having a low boiling point is omitted or the enhancement in the polymer concentration is low. However, when the polymer concentration of the solution is enhanced, the spread state of the spun yarn becomes so poor that the quality of the sheet products lowered. Therefore, also from the viewpoint of spinnability, it is understood that methylene chloride cannot be used.

The proposal in U.S. Pat. No. 5081177 wherein use is made of an alternative flon has a problem. Specifically, studies in recent years have revealed that 1,1-dichloro-2,2,2-trifluoroethane and its isomers give rise to a tumor in rats, although it is benign. Further, since these alternative flons are a poor solvent for a high-density polyethylene, which is a typical example of a polyolefin, they cannot dissolve the high-density polyethylene when used alone. For this reason, to improve the solubility, a technique wherein a hydrocarbon, methylene chloride, etc. are used as a co-solvent is simultaneously disclosed. However, even when the alternative flon is allowed to exist together with the hydrocarbon, methylene chloride or the like, since the proportion of the alternative flon in the solvent is high and 50% or more, the property that the alternative flon is a poor solvent for the high-density polyethylene strongly remains, so that it is difficult to dissolve the high-density polyethylene. Therefore, a problem that the dissolution rate is low remains unsolved. Thus, 1,1dichloro-2,2,2-trichloroethane and its isomers have problems of the toxicity and the dissolution of the high-density polyethylene. Similarly, 1,1-dichloro-2,2-difluoroethane and its isomers have problems of the toxicity (toxicity against genital organs) and the dissolution of the high-density polyethylene. On the other hand, 1,1-dichloro-1-fluoroethane and its isomers dissolve the high-density polyethylene and provide a good yarn even when used alone. These solvents, however, are highly liable to thermal decomposition. Even when dissolution is conducted by means of an extruder, they are liable to thermally decompose with evolution of a large amount of hydrogen chloride or hydrogen fluoride to give a halogenated oligomer. These decomposition products give rise to serious problems such as coloring of a product and corrosion of a spinning apparatus. Further, 1,1-dichloro-1-fluoroethane as the solvent has an ozone depletion potential (ODP) exceeding 0.1, i.e., unfavorably has a high capability of depleting ozone. Therefore, 1,1-dichloro-1-fluoroethane and its isomers cannot be used as a solvent for flash spinning because they are highly liable to thermal decomposition and have a high capability of depleting ozone.

The technique proposed in EP 357364A4 cannot be used as a solvent for flash spinning for the reasons set out above because methylene chloride is used as the solvent.

The spinning process proposed in EP 431801 wherein flash spinning is conducted through the use of a solvent comprising carbon dioxide and water can be applied to a particular polyolefin having a high hydrophilicity as a comonomer component. Since, however, this solvent has a poor capability of dissolving general polyolefins, i.e., polyethylene and polypropylene, it is substantially impossible to prepare a fiber having favorable properties. Further, in this method, it is practically necessary to use a surfactant in combination with the solvent. This not only renders the process complicated but also causes the surfactant to remain in the resultant fiber to lower the practical properties.

Further, in a technique proposed in EP 0414498A2 wherein use is made of a mixed system comprising a water-containing organic solvent, since the solvent used is highly combustible, this technique cannot be used.

The spinning process using 1,1-dichloro-2,2,3,3,3-pentafluoropropane and/or 1,3-dichloro-1,2,2,3,3-pentafluoropropane mixed with hydrocarbon derivative proposed in Japanese Unexamined Patent Publication (Kokai) No. 4-185708 has a drawback due to use of the hydrocarbon derivative having a flammability and a high toxicity. Accordingly, this process cannot be applied to a practical production.

Thus, all the solvents alternative to trichlorofluoromethane for flash spinning proposed up to now apparently have an unsolved problem, and no satisfactory solvent which can be used instead of trichlorofluoromethane has been proposed in the art.

SUMMARY OF THE INVENTION

An object of the present invention is to provide a solvent which can be used as the alternative to trichlorofluoromethane or is superior to trichlorofluoromethane. More specifically, an object of the present invention is to provide a solvent which is excellent as a solvent for flash spinning of a polyolefin and less combustible and has a low toxicity and a capability of depleting ozone.

Another object of the present invention is to provide a polymer solution using said solvent.

A further object of the present invention is to provide an improved flash spinning process for a polyolefin which enables a three-dimensional fiber having a high strength and an excellent spreadability to be prepared through the use of said solvent. It is a matter of course that the solvent and solution according to the present invention can be utilized also as, for example, a reaction solvent, a foaming agent and a cleaning agent which are used as an alternative flon in other technical regions where their properties can be utilized.

The present inventors have made extensive studies with a view to attaining the above-described objects through trial-and-error experiments on how to prepare a fiber having properties comparable or superior to those of a three-dimensional polyolefin fiber formed by the conventional flash spinning process, which has led to the completion of the present invention.

Specifically, the first invention is directed to a halogen solvent comprising a mixed solvent consisting essentially of at lease one solvent selected from the group consisting of bromochloromethane and 1,2-dichloroethylene, and a co-solvent, wherein said co-solvent is at least one member selected from the group consisting of carbon dioxide, sulfur hexafluoride, difluorochloromethane, 1,1,1,2-tetrafluoroethane, 1-chloro-1,2,2,2-tetrafluoroethane, 1-chloro-1,1-difluoroethane, 1,1-dichloro-2,2,3,3,3-pentafluoropropane, 1,3-dichloro-1,2,2,3,3-pentafluoropropane, dodecafluoropentane and tetradecafluorohexane, the content of said co-solvent in the mixed solvent being 3 to 65% by weight.

The bromochloromethane or the 1,2-dichloroethylene can be used as the solvent selected from the group. The mixed solvent is essentially a two-component solvent comprised of bromochloromethane and 1,2-dichloroethylene and a co-solvent, and the content of bromochloromethane in the two-component solvent is preferably 40 to 75% by weight, and a proportion of the co-solvent in the mixed solvent is preferably 10 to 30% by weight.

A 0.001 to 5% by weight, based on the mixed solvent, of at least one stabilizer selected from the group consisting of propylene oxide, 1,2-butylene oxide, nitromethane, a phosphite represented by the following structural formula (1), a diphosphite represented by the following structural formula (2) and a diphosphite represented by the following structural formula (3) may be contained in said mixed solvent:

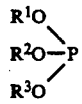

(1)

wherein $R^1$, $R^2$ and $R^3$ which may the same or different each stand for a monovalent hydrocarbon group having 1 to 30 carbon atoms;

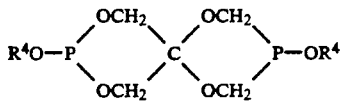

(2)

wherein $R^4$ stands for a monovalent hydrocarbon group having 8 to 30 carbon atoms; and

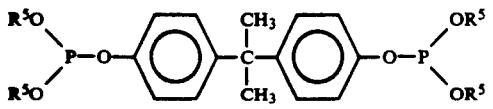

(3)

wherein $R^5$ stands for a monovalent hydrocarbon group having 8 to 30 carbon atoms.

The second invention is directed to a polyolefin solution prepared under high temperature and high pressure conditions, wherein a halogen solvent is used as a solvent, said halogen solvent comprising a mixed solvent consisting essentially of at least one solvent selected from the group of bromochloromethane and 1,2-dichloroethylene, and a co-solvent is used as a solvent, said co-solvent is at least one member selected from the group consisting of carbon dioxide, sulfur hexafluoride, difluorochloromethane, 1,1,1,2-tetrafluoroethane, 1-chloro-1,1-difluoroethane, 1-chloro-1,2,2,2-tetrafluoroethane, 1,1-dichloro-2,2,3,3,3-pentafluoropropane, 1,3-dichloro-1,2,2,3,3-pentafluoropropane, dodecafluoropentane and tetradecafluorohexane, the content of said co-solvent in the mixed solvent being 3 to 65% by weight, and the concentration of a polyolefin in said polyolefin solution is 5 to 25% by weight.

The third invention is directed to a process for producing a three-dimensional polyolefin fiber, comprising passing a polyolefin solution prepared under high temperature and high pressure conditions through a pressure let-down orifice, a pressure let-down chamber and a spinneret into a region where the temperature and pressure are room temperature and atmospheric pressure, respectively, to prepare a fibrilated, three-dimensional polyolefin fiber, wherein a mixed solvent consisting essentially of at least one solvent selected from the group consisting of bromochloromethane and 1,2-dichloroethylene and a co-solvent is used as a solvent, said co-solvent being at least one member selected from the group consisting of carbon dioxide, sulfur hexafluoride, difluorochloromethane, 1,1,1,2-tetrafluoroethane, 1-chloro-1,2,2,2-tetrafluoroethane, 1-chloro-1,1-difluoroethane, 1,1-dichloro-2,2,3,3,3-pentafluoropropane, 1,3-dichloro-1,2,2,3,3-pentafluoropropane, dodecafluoropentane and tetradecafluorohexane, the content of said co-solvent in the mixed solvent being 3 to 65% by weight, and the concentration of a polyolefin in said polyolefin solution is 5 to 25% by weight.

The mixed solvent consisting essentially of a two-component solvent comprised of bromochloromethane and 1,2-dichloroethylene and a co-solvent is preferably used and, the content of bromochloromethane in the two-component solvent may be 40 to 75% by weight.

As opposed to the conventional process, the present inventors can prepare a three-dimensional fiber of a polyolefin having a very high strength and a good spreadability despite the use of a solvent having a small capability of depleting ozone.

DESCRIPTION OF THE PREFERRED EMBODIMENTS

Figure 1:
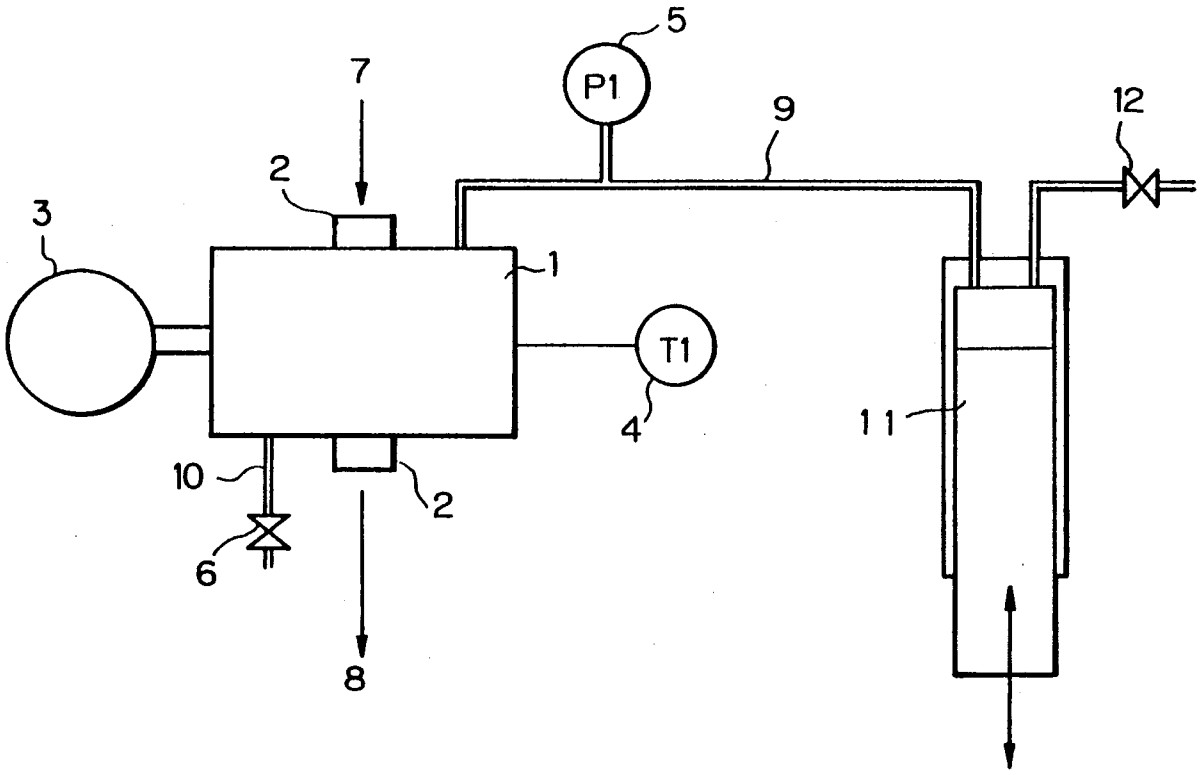
FIG. 1 is a schematic diagram of a measuring device wherein use is made of an optical cell vessel for measuring the cloud point of a polymer solution.

As described above, the solvent used for flash spinning should be an organic solvent which can be gasified under room temperature and atmospheric pressure conditions. Specifically, a polyolefin is dissolved under high temperature and high pressure conditions, once subjected to a reduction in the pressure to give rise to a change from a transparent solution to an opaque solution and passed through a spinneret to inject the opaque polymer solution into an atmosphere where the temperature and the pressure are room temperature and atmospheric pressure, respectively. At that time, the organic solvent is gasified to form a supersonic gas jet. The gas jet causes the polymer to be solidified and, at the same time, to be drawn, thereby forming a three-dimensional fiber having a high strength.

As described above, the properties which the solvent for flash spinning should have are widely known in the art, and will now be described in more detail.

(1) The solvent does not dissolve the polymer at all under room temperature and atmospheric conditions and dissolves the polymer at a temperature above the melting point of the polymer and a pressure much higher than the atmospheric pressure.

(2) A phase change from a transparent solution to an opaque solution occurs at a temperature in the range of from a temperature above the melting point of the polymer to a temperature at which no thermal deterioration occurs. In particular, in the case of flash spinning, it is preferred that the polymer solution have a phase diagram known as a LCST (lower critical solution temperature) phase diagram in the theory of a polymer solution. In this case, it is preferred for the solvent for flash spinning as well to have an LCST phase diagram. It is still preferred that the polymer solution has an LCST phase diagram and gives rise to a phase change in a moment. This property is important because in the flash spinning, the phase change from a transparent solution to an opaque solution is conducted by varying the pressure.

(3) The solvent should be gasified immediately after ejection from the spinneret. This means that the solvent should have a boiling point near room temperature under atmospheric pressure. That is, the solvent should be an organic solvent having a low boiling point.

(4) The change between before and after the spinneret is a substantially isoentropic change. Therefore, a liquid/gas mixture spontaneously occurs at the outlet of the spinneret. This mixture, as such, cannot be used because it provides a wet three-dimensional fiber. However, since the polymer has heat, the heat gasifies the liquid to form a dried three-dimensional fiber. This means that the heat of vaporization of the organic solvent should be proper.

(5) The solvent should have an excellent thermal stability because it is exposed to a temperature above the melting point of the polymer. In the present invention, the term "thermal stability" used in the present invention is intended to mean that the solvent is difficult to thermally decompose under a temperature at which the polymer is dissolved.

(6) The solvent should be noncombustible or flame-retardant because a sealed space having a large volume is filled with a gas and electrical facilities which can become an ignition source are provided within the sealed space.

(7) The solvent should be nontoxic because the gas filled into the sealed space often comes into contact with men.

(8) The corrosivity of the solvent should be low because the whole flash spinning device is a high pressure equipment.

(9) The ODP should be low, preferably less than 0.01.

The satisfaction of the requirements of low boiling point, LCST polymer solution, thermal stability, low combustibility, nontoxicity and low ODP are particularly important to the solvent.

The present inventors have conducted many experiments with a view to finding a solvent for flash spinning capable of satisfying the six requirements, that is, low boiling point, LCST polymer solution, thermal stability, low combustibility, nontoxicity and low ODP.

As a result, they have found that a mixed solvent consisting essentially of bromochloromethane and/or 1,2-dichloroethylene and a co-solvent comprising at least one member selected from the group consisting of carbon dioxide, sulfur hexafluoride, difluorochloromethane, 1,1,1,2-tetrafluoroethane, 1-chloro-1,1-difluoroethane, 1-chloro-1,2,2,2-tetrafluoroethane, 1,1-dichloro-2,2,3,3,3-pentafluoropropane, 1,3-dichloro-1,2,2,3,3-pentafluoropropane, dodecafluoropentane and tetradecafluorohexane can completely or substantially completely satisfy the above-described six requirements.

The reason why the solvent and solution according to the present invention can satisfy the six requirements necessary particularly for flash spinning will now be described. Further, features of the solvent and a preferred composition range thereof will be described.

For simplification, in the following description, difluorochloromethane will be referred to as "HCFC-22", 1,1,1,2-tetrafluoroethane as "HFC-134a", 1-chloro-1,1-difluoroethane as "HCFC-142b", 1-chloro-1,2,2,2-tetrafluoroethane as "HCFC-124", 1,1-dichloro-2,2,3,3,3-pentafluoropropane as "HCFC-225ca", 1,3-dichloro-1,2,2,3,3-pentafluoropropane as "HCFC-225cb", dodecafluoropentane as "FC-6112", and tetradecafluorohexane as "FC-7114".

(1) Toxicity

Bromochloromethane and 1,2-dichloroethylene each have a TLV value established by ACGIH of 200 ppm which is a high value (that is, has a low toxicity) for chloro compounds. The TLV value of the co-solvent is, for example, 5000 ppm for carbon dioxide and 1000 ppm for sulfur hexafluoride, and these co-solvents are known to have a very low toxicity. With respect to other co-solvents, although no TLV is specified, the toxicity is considered to be very small. Further, there is no report on all of these solvents that they cause carcinogenicity in human beings. Therefore, although the solvent for flash spinning of the present invention comprising these solvents is not completely nontoxic, the toxicity is considerably low. It does not injure health of human beings as long as attention is given to the leakage of gas and the ventilation of the working space, the control of gas concentration is maintained in the working space and a protector such as an air line mask is worn when human beings come into contact with the gas.

(2) Combustibility and Thermal Stability

Bromochloromethane and 1,2-dichloroethylene are often thermally decomposed upon being exposed to a high temperature, so that it is necessary to use a stabilizer or the like according to need. Although many stabilizers are nowadays developed, only a few stabilizers can exhibit the effect under high temperature and high pressure conditions (typical temperature and pressure are about 200° C. and 200 kg/cm$^2$, respectively) necessary for flash spinning. The reason for this is that the service condition of the solvent is very severe and since the stabilizer used herein is a stabilizer for the solvent, the use of the stabilizer in an excessively large amount causes the stabilizer to be concentrated in a yarn after spinning, so that the solvent blooms or bleeds from the yarn. Therefore, a stabilizer which can exhibit a high effect in a small amount under high temperature and high pressure conditions is necessary. As a result of investigations and studies on many stabilizers, it has been found that epoxy compounds, nitro compounds, diphosphites and phosphites are useful as the stabilizer. In particular, the diphosphite exhibited a high thermal stabilization effect. Further, as a result of detailed studies on the structure of the stabilizer, propylene oxide, 1,2-butylene oxide, nitromethane, a phosphite represented by the structural formula (1), a diphosphite represented by the structural formula (2) and a diphosphite represented by the structural formula (3) are particularly excellent as the stabilizer.

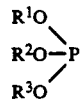
(1)

wherein $R^1$, $R^2$ and $R^3$ which may the same or different each stand for a monovalent hydrocarbon group having 1 to 30 carbon atoms;

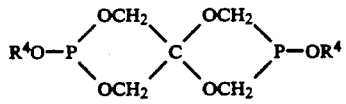
(2)

wherein $R^4$ stands for a monovalent hydrocarbon group having 8 to 30 carbon atoms; and

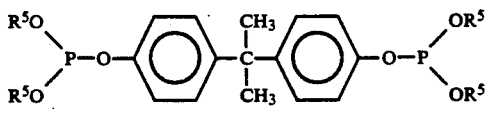
(3)

wherein $R^5$ stands for a monovalent hydrocarbon group having 8 to 30 carbon atoms.

In the present invention, $R^1$, $R^2$ and $R^3$ which may be the same or different each stand for a monovalent hydrocarbon group, and examples thereof include n-$C_nH_{n+1}$, iso-$C_nH_{n+1}$ wherein n is an integer of 1 to 30, a phenyl group and a benzene ring partially provided with an alkyl group. In these combinations, it is preferred for one or two of $R^1$, $R^2$ and $R^3$ to have an aromatic group from the view-point of enhancing the thermal stability. Further, it is preferred for the remaining one or two of $R^1$, $R^2$ and $R^3$ to be an aliphatic hydrocarbon wherein n is 8 or more. $R^4$ and $R^5$ stand for a monovalent aliphatic hydrocarbon group having 8 to 30 carbon atoms, and examples thereof include n-$C_nH_{n+1}$ and iso-$C_nH_{n+1}$ wherein n is an integer of 8 to 30; n is preferably 12 to 24, still preferably 16 to 20 from the viewpoint of enhancing the thermal stability.

These stabilizers may be used alone or in combination with other stabilizers and additives. Examples of other stabilizers and additives include dibutyltin maleate, metallic soap, phenol derivatives, catechol derivatives, methanol, ethanol, methyl acetate, ethyl acetate, β-diketone derivatives, pyridine, tertiary amines such as tributylamine and N,N-dimethylpyridine derivatives.

Among the stabilizers used in the present invention, the diphosphite represented by the structural formula (2) has the highest effect of reducing the decomposition reaction of the solvent. Since, however, the diphosphite has a low solubility in the solvent, other stabilizers may be used depending upon the process. With respect to the amount of use of the stabilizer, at least one stabilizer according to the present invention can be used in an amount of about 0.001 to 5% by weight based on the mixed solvent of the present invention. In the case of the epoxy compound and diphosphite, it is possible to exert the thermal stabilization effect in an amount of 0.001 to 0.1% by weight. In order to enhance the effect of the stabilizer, it is preferred for the bromochloromethane and 1,2-dichloroethylene and the co-solvent to be a substantially pure substance. In particular, the amount of free acids, for example, hydrogen chloride and hydrogen bromide, and the water content are preferably as small as possible and particularly preferably 10 ppm or less.

All the co-solvents used in the present invention except for HCFC-142b are a completely noncombustible solvent. Therefore, one important purpose of the mixing of the two chloro compounds with a co-solvent is to remarkably lower the combustibility of the solvent of the invention.

Although HCFC-142b is combustible, it has a narrow explosive range of 9 to 15 vol.% and is therefore a flame retardant substance. Therefore, a solvent is prepared through the use of HCFC-142b is flame-retardant, so that the solvent can be used in the production in a completely sealed process.

Bromochloromethane is a completely noncombustible solvent known as a powerful fire extinguisher called CB and exhibits a very high combustion inhibitory effect. A mixed solvent comprising bromochloromethane and the co-solvent except for HCFC-142b is completely noncombustible in any solvent composition.

1,2-Dichloroethylene has an explosive range of 9.7 to 12.8 vol.% and is a "flame-retardant substance". 1,2-Dichloroethylene has a very high lower explosion limit, and a completely noncombustible or flame-retardant solvent can be very easily formed by mixing 1,2-dichloroethylene with a noncombustible solvent. The co-solvent according to the present invention is very favorable as such a noncombustible solvent. The solvent composition of the present invention is very useful also for reducing or completely eliminating the combustibility, and the proportion of 1,2-dichloroethylene is preferably 70 to 90% by weight, particularly preferably 70 to 80% by weight.

A solvent which is completely noncombustible, and at the same time, has excellent thermal stability can be prepared through a combination of 1,2-dichloroethylene with bromochloromethane.

The explosive range can be reduced by adding a noncombustible substance to a combustible solvent. For this reason, bromochloromethane was used as the noncombustible substance for improving the combustibility of 1,2-dichloroethylene. Bromochloromethane is low in the toxicity, and as will be described later, is an excellent good solvent for a polyolefin under high temperature and high pressure conditions. Further, it is a very excellent sole substance as a combustion inhibitory substance with a mind to flash spinning because it has a bromine atom having a combustion inhibitory effect. For example, chloroform, carbon tetrachloride, chloroform, methylene bromide and bromoform as well has a high combustion inhibitory effect. Since, however, all of these compounds have a high toxicity, they cannot be used for flash spinning.

As a result of studies on the combustibility of a mixed solvent comprising a two-component solvent consisting of 1,2-dichloroethylene and bromochloromethane and a co-solvent, it has been found that the proportion of bromochloromethane in the two-component solvent is about 40% by weight and the solvent is completely noncombustible. Therefore, in the preparation of a two-component solvent which is completely noncombustible, the proportion of bromochloromethane in the two-component solvent should be 40% by weight or more.

1,2-Dichloroethylene is superior to bromochloromethane in the thermal stability. Therefore, it is preferred to minimize the amount of use of bromochloromethane. On the other hand, when 1,2-dichloroethylene is mixed with bromochloromethane for the purpose of improving the thermal stability, it is possible to ensure a thermal stability comparable or superior to that of trichlorofluoromethane. This derives from not only the dilution effect attained by a lowering in the content of bromochloromethane in the solvent but also the effect of inhibiting the thermal decomposition of bromochloromethane by 1,2-dichloroethylene. Specifically, 1,2-dichloroethylene can remarkably inhibit the generation of a decomposition product by virtue of the presence of a double bond. In order to attain such an excellent thermal stability, the proportion of bromochloromethane in the two-component solvent consisting of bromochloromethane and 1,2-dichloroethylene should be 75% by weight or less, preferably 60% by weight, still preferably 50% by weight.

Therefore, the proportion of bromochloromethane in the two-component solvent consisting of 1,2-dichloroethylene and bromochloromethane is 40 to 75% by weight, preferably 40 to 60% by weight, still preferably 50 to 60% by weight. In the mixed solvent of the present invention comprising a two-component solvent consisting of 1,2-dichloroethylene and bromochloromethane and a co-solvent, the mixing ratio of the co-solvent is generally 3 to 50% by weight, particularly preferably 5 to 30% by weight, still preferably 10 to 30% by weight.

Although bromochloromethane has a low thermal stability, it can be used without causing any practical problem when a solution is prepared through the use of an extruder having a short residence time under high temperature and high pressure conditions or the spinning time is set to a relatively low value.

(3) Boiling point

Carbon dioxide, HCFC-22, HFC-134a, HCFC-142b and HCFC-124 are gaseous under room temperature and atmospheric pressure conditions. Accordingly, one of important purposes of the mixing of the two chloro compounds with a gaseous co-solvent is to remarkably lower the boiling point of the solvent for flash spinning according to the present invention.

Since the gasification is conducted under room temperature and atmospheric pressure conditions, the boiling point is preferably 60° C. or below, still preferably 50° C. or below. In the mixed solvent, the boiling point is a function of the composition of the solvent and can be freely adjusted by varying the mixing ratio of the gaseous co-solvent.

Bromochloromethane has a boiling point of 68° C. 1,2-Dichloroethylene has two isomers, that is, trans and cis isomers. The boiling point of trans-1,2-dichloroethylene is 47.7° C., while the boiling point of cis-1,2-dichloroethylene is 60.25° C. Therefore, the boiling point of the present invention can be regulated to a desired value of 60° C. or below.

Although HCFC-225ca (boiling point: 51.1° C.), HCFC-225cb (boiling point: 56.1° C.), FC-6112 (boiling point: 30° C.) and FC-7114 (boiling point: 56° C.) have a relatively high boiling point, a solvent having a boiling point of about 60° C. or below can be prepared even when use is made of these co-solvents.

When spinning was conducted through the use of the solvent according to the present invention, no spun yarn is wet.

(4) Cloud point curve

A LCST polymer solution is prepared by dissolving a polyolefin in the solvent used in the present invention. As described above, according to the fundamental principle of the flash spinning, a polymer solution under high temperature and high pressure conditions is subjected to a reduction in the pressure to give rise to a phase separation, thereby forming an opaque solution comprising two phases, that is, a polymer phase and a solvent phase. Therefore, the temperature and pressure at the cloud point which can be judged by a change of a transparent solution to an opaque solution are very important. The cloud point is also a point at which a phase separation occurs. In polymer chemistry, a diagram in which the cloud point is plotted on the coordinates for temperature and pressure is called a cloud point curve. The flash spinnability of the solvent can be judged by the position of the cloud curve on the coordinates for temperature and pressure.

Figure 2:
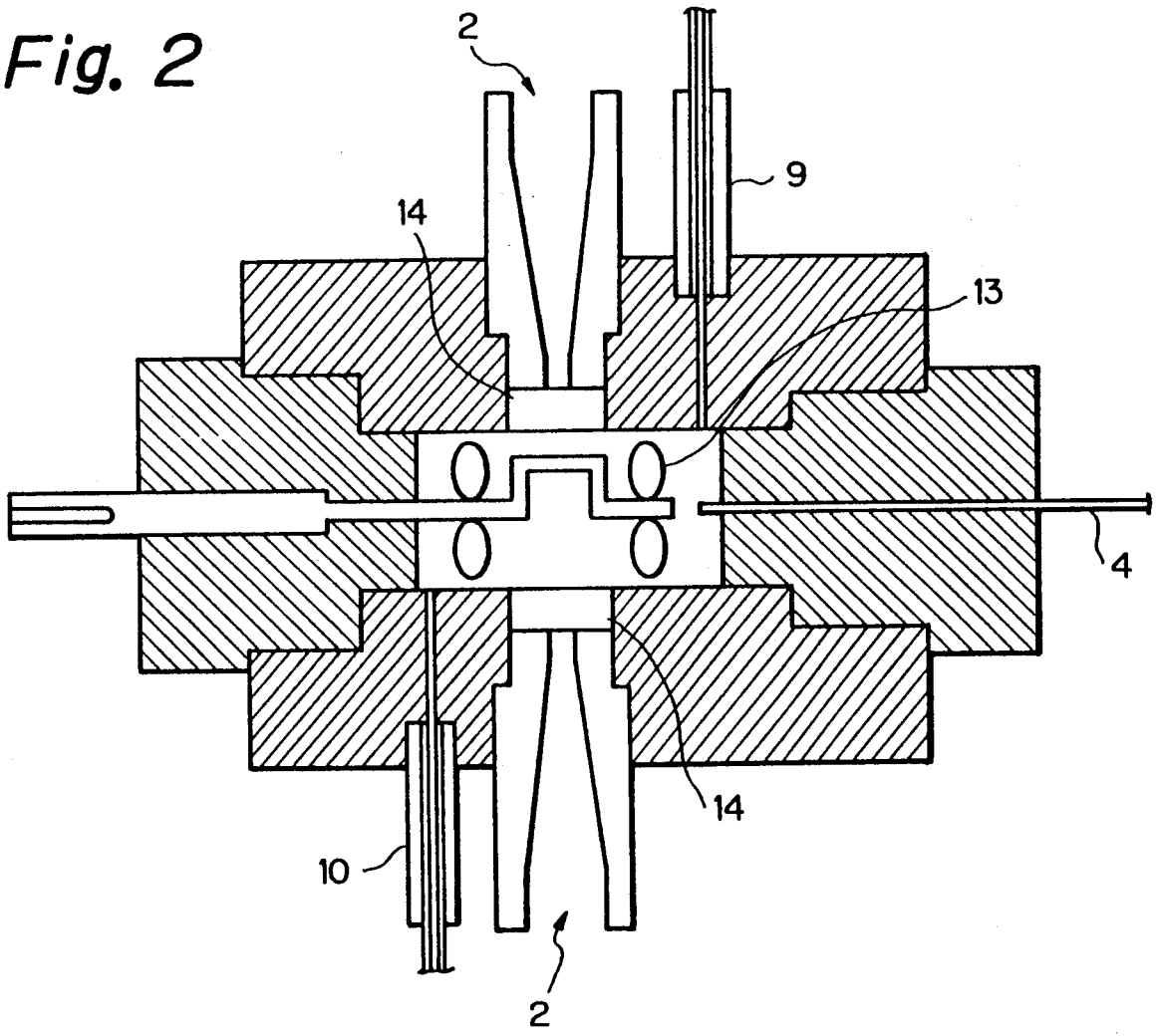
FIG. 2 is a schematic diagram of an optical cell vessel for measuring the cloud point.

In the present invention, the cloud point curve was measured by means of an apparatus shown in FIGS. 1 and 2. FIG. 1 is an explanatory view of the whole apparatus, and FIG. 2 is an explanatory view of an optical cell vessel for measuring the cloud point. Specifically, the optical cell vessel (internal dimension: 40 mm in diameter × 83 mm in length, capacity: about 100 $cm^3$) 1 is provided with two optical windows so that the inside of the cell can be observed by passing light through the windows. The thickness of glass 14 of the optical window 2 is 9 mm per glass. Since two glasses are provided, the total thickness is 18 mm. The thickness of the solution is 40 mm. Therefore, the length of an optical path through which the light passes is 58 mm in total. The optical cell vessel 1 contains an agitating blade 13 which agitates the inside of the vessel at about 180 rpm until the polymer is dissolved. The structure of the agitating blade is such that two blades are provided and the shaft which abuts against the optical windows is formed into a "⊐" shape. Further, a thermometer 4 is inserted so as to come into direct contact with the solution within an optical cell vessel. The pressure gage 5 is provided in the course of piping 9 to detect the pressure within the optical cell vessel. In order to adjust the liquid pressure within the optical cell vessel, a plunger pressure controller is provided through the piping 9. Further, a vent for venting a gas within the optical cell vessel and piping 10 for pushing out the liquid within the vessel are provided. Further, the whole optical cell vessel is covered with an aluminum cast heater, and the temperature of the control circuit is regulated.

The cloud point is measured as follows. At the outset, a polymer and a solvent were weighed so that the polymer concentration becomes a predetermined one and the inside of the vessel was sealed by liquid and fed in the vessel. The preparation of the polymer solution was conducted in terms of % by volume for simplification of the experiment. When use was made of a gaseous co-solvent, a mixed solvent comprising solvents in a predetermined mixing ratio was previously prepared in a stainless steel bomb having a capacity of 300 $cm^3$, and introduced into an optical cell vessel by the application of pressure through the use of a nitrogen gas. On the other hand, when use was made of a liquid co-solvent, the mixed solvent as prepared was introduced into an optical cell vessel. In any case, a predetermined amount of a polymer was placed in an optical cell vessel, the optical cell vessel was evacuated to avoid the influence of the air, and the mixed solvent was then introduced into the optical cell vessel. Then, the liquid was heated. The pressure within the container increased with expansion of the liquid. The temperature rise rate was 4.5° C./min. After the pressure and the temperature reached around 50 $kg/cm^2$ and 105° C., respectively, the pressure was not regulated until the polymer was completely dissolved. Thus, the polymer of which the temperature reached around the melting point of the polymer began to dissolve in the solvent. In this state, the polymer solution was prepared.

Then, the measurement of the cloud point was conducted. The pressure was varied by means of a plunger pressure controller while raising the temperature to determine a point at which the solution begins to cloud, that is, a cloud point, with the naked eye.

When 1,2-dichloroethylene is used alone, the cloud point curve exists at a very low pressure in a flash spinning temperature range and the cloud point cannot be observed so far as the temperature is not raised to a considerably high temperature. For example, when use is made of a high-density polyethylene having a weight average molecular weight of 102000, in a concentration as low as 2 vol.%, a cloud point curve is observed at last on a line formed by connecting a point of 62 $kg/cm^2$ at 220° C. to a point of 83 $kg/cm^2$ at 230° C. (since the pressure at the cloud point lowers with decreasing the polymer concentration, no cloud point curve is observed in a practical polymer concentration). This shows that 1,2-dichloroethylene is a good solvent for a polyolefin under high temperature and high pressure conditions. Further, this shows that bromochloromethane has a higher solubility than 1,2-dichloroethylene, i.e., is a very excellent good solvent for a polyolefin under high temperature and high pressure conditions. For example, when use is made of the above-described high-density polyethylene, no cloud point can be observed even in a concentration as low as 2 vol.%.

On the other hand, the co-solvent cannot dissolve a polymer in the flash spinning temperature range. Therefore, the cloud point curve could be brought into a position suitable for flash spinning through a combination of the above-described two chloro compounds as the good solvent for the polyolefin with the co-solvent under high temperature and high pressure conditions. The cloud point pressure is preferably about 80 to 300 kg/cm$^2$ at 200° C., particularly preferably about 120 to 230 kg/cm$^2$. When the preferred cloud point pressure was calculated in terms of a preferred mixing ratio of the co-solvent, in all the chloro compounds, the mixing ratio was generally 3 to 65% by weight, particularly preferably 5 to 30% by weight, still preferably 10 to 30% by weight. The amount of the co-solvent is particularly preferably 10 to 20% by weight for carbon dioxide, 5 to 20% by weight for sulfur hexafluoride, 15 to 30% by weight for HCFC-22, 15 to 25% by weight for HFC-134a, 20 to 40% by wight for HCFC-142b, 15 to 30% by weight for HCFC-124, 30 to 65% by weight for HCFC-225ca, 30 to 65% by weight for HCFC-225cb, 15 to 30% by weight for FC-6112 and 15 to 30% by weight for FC-7114. Although the above-described preferred amount of the co-solvent slightly varies depending upon the kind and degree of polymerization of the polymer, it is roughly in the above-described range. It is a matter of course that these co-solvents may be used in the form of a mixture of two or more thereof and a new solvent may be separately added. With respect to 1,2-dichloroethylene, in the cis isomer, the cloud point was observed at a slightly lower pressure than the trans isomer. However, the difference in the cloud point between the trans isomer and the cis isomer gave rise to no problem.

Figure 3:
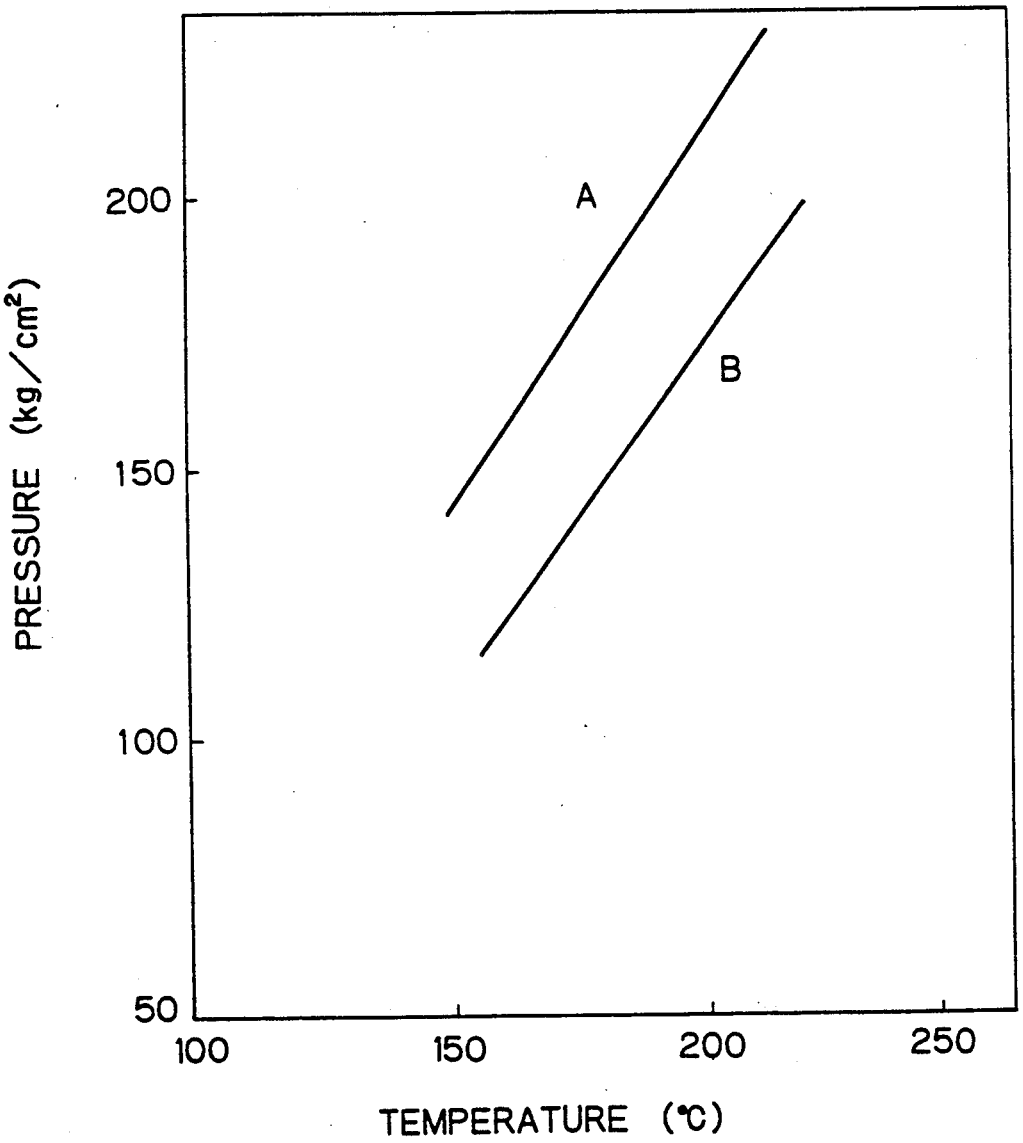
FIG. 3 is a graph showing an example of a cloud point curve of the polymer solution according to the present invention, that is, a graph showing cloud point curves of solvents respectively having compositions of A) bromochloromethane/carbon dioxide (85/15% by weight) and B) bromochloromethane/HFC-134a (80/20% by weight) and (75/25% by weight)
Figure 4:
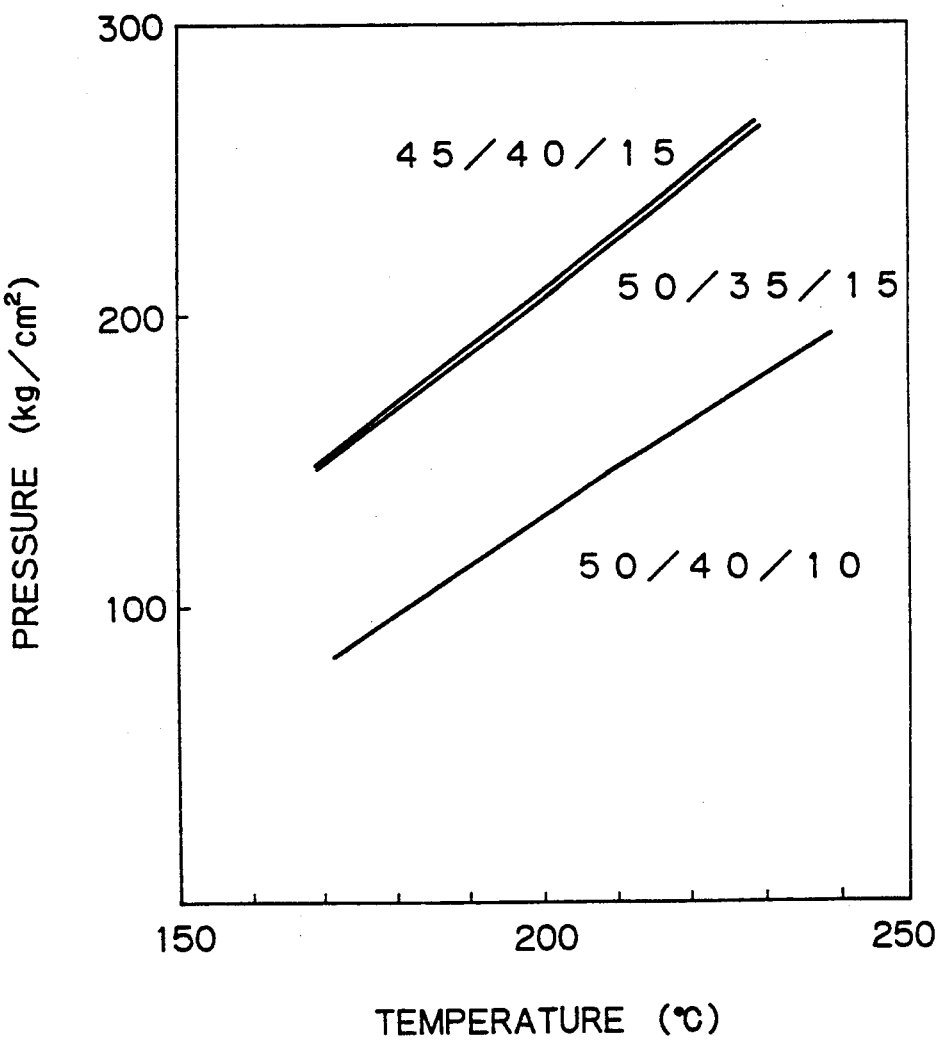
FIG. 4 is a graph showing cloud point curves of solvents respectively having compositions of trans-1,2-dichloroethylene/bromochloromethane/carbon dioxide (45/40/15% by weight), (50/35/15% by weight) and (50/40/10% by weight).

FIGS. 3 and 4 are each an example of the cloud point curve. Specifically, FIG. 3 is a graph showing cloud point curves of solvents respectively having compositions of A) bromochloromethane/carbon dioxide (85/15% by weight) and B) bromochloromethane/HFC-134a (80/20% by weight) and (75/25% by weight). In each cloud curve, the upper region comprises a single phase, while the lower region comprises two phases. The polymer is a high-density polyethylene having a density of 0.97 g/cm$^3$ and a weight average molecular weight of 102000 (degree of dispersion: 6.14). The polymer concentration of the solution is 18 vol.%. On the other hand, FIG. 4 is a graph showing cloud point curves of three kinds of solvents respectively having compositions of trans-1,2-dichloroethylene/-bromochloromethane/carbon dioxide (45/40/15% by weight), (50/35/15% by weight) and (50/40/10% by weight). In each cloud curve, the upper region comprises a single phase, while the lower region comprises two phases. The polymer is a high-density polyethylene having a density of 0.97 g/cm$^3$ and a weight average molecular weight of 102000 (degree of dispersion: 6.14). The polymer concentration of the solution is 18 vol.%.

It is a matter of course that it was confirmed that the position of the cloud point curve varies depending upon the composition ratio of the two chloro compounds to the co-solvent. This shows that thermodynamic properties of the polymer solution vary according to the solvent composition ratio. A cloud point curve could be obtained in the case of other compositions and other co-solvents as well. A spinning experiment was conducted through the use of the results to find a proper solvent and its composition.

No homogeneous solution can be prepared even though bromochloromethane and/or 1,2-dichloroethylene were mixed with sulfur hexafluoride, FC-6112 and FC-7114 at room temperature under autogenous pressure. However, a homogeneous solution can be prepared by increasing the temperature and/or pressure. Therefore, when a homogeneous solution is prepared, it is necessary to regulate the temperature and the pressure. In general, a homogeneous solution can be prepared at a temperature of 140° C. or above for bromochloromethane and 80° C. or above for 1,2-dichloroethylene.

(5) ODP

The life of the halogen compound in the air is determined by an active chemical species called "OH radical". This is formed by reacting oxygen with an organic substance under ultraviolet rays from the sun. Since boromochloromethane is a chloro compound having a hydrogen atom, it is very easily reacted with the OH radical in the air. Therefore, the ODP value of bromochloromethane is substantially zero. Since 1,2-dichloroethylene has a double bond, it is difficult to remain in the air through a reaction thereof with the OH radical. For this reason, the life of 1,2-dichloroethylene in the air is short. Since the ODP value is determined by taking the life in the air into consideration, the order of the ODP is as follows. Particular flon and carbon tetrachloride > alternative flon > methylene chloride (ODP: 0.003) > halogen compound having a double bond (for example, 1,2-dichloroethylene). Therefore, the ODP value of 1,2-dichloroethylene is substantially zero.

On the other hand, since carbon dioxide, sulfur hexafluoride, HFC-134a, FC-6112 and FC-7114 have a non-flon structure, it is a matter of course that their ODP values are substantially zero. Since the solvent of the present invention wherein use is made of these co-solvents consists essentially of a solvent having no capacity of depleting ozone, it can be used without causing any problem over future. Up to now, some flash spinning solvents wherein use was made of alternative flons having a low ODP value have been disclosed. All of these solvents have a capability of depleting ozone although the level is low. The regulation of flon is nowadays strengthened day by day. It is apparent that no matter how the present invention capable of providing a solvent which has no capability of depleting ozone and noncombustible and low toxic properties is important and excellent. On the other hand, since hydrochlorocarbons, that is, HCFC-22, HCFC-142b, HCFC-124, HCFC-225ca and HCFC-225cb, have an ODP value on the order of 0.01, there is a possibility that the use of these hydrocarbons is prohibited within 20 years due to the strengthening of the regulation.

In view of the above-described limitations (1) to (5), observation and experimental results, the mixing ratio of the co-solvent is preferably 5 to 30% by weight, particularly preferably 10 to 30% by weight because the ODP value is substantially zero. Among the co-solvents, carbon dioxide, sulfur hexafluoride, HFC-134a, FC-6112 and FC-7114 are preferred, and carbon dioxide and HFC-134a which are homogeneous and have a high handleability are preferred.

1,2-Dichloroethylene gives rise to an isomerization reaction under high temperature and high pressure conditions. When the recovery of the solvent is taken into consideration, such an isomerization means that the proportion of the isomer varies each time the recovery is conducted. However, it has been found that, under flash spinning conditions, the composition becomes equilibrium when the proportion of the trans isomer is between 30% by weight and 40% by weight. Therefore, 1,2-dichloroethylene having a determined isomer proportion can be handled independently of the number of recoveries when the proportion of the isomer is controlled within this range. This control is very important to stable production. When the solvent of the present invention is used at 100° C. or below, since substantially no isomerization reaction occurs, the use and recovery of the solvent can be stably repeated even when use is made of 1,2-dichloroethylene having any isomer proportion.

A three-dimensional fiber spun through the use of a flash spinning solvent of the present invention thus determined did not wet and had a good spreadability and a high strength and could be formed into a good nonwoven fabric sheet.

The weight ratio of the flash spinning solvent to the polyolefin used in the production of a three-dimensional polyolefin fiber is 5 to 25% by weight. In this range, a three-dimensional fiber of a polyolefin having an excellent opening property and a high strength can be easily produced. When the weight ratio is 5% by weight or less, the yarn is in the form of a pulp or has a low strength. On the other hand, when the weight ratio is 25% by weight or more, the opening property of the yarn becomes low. Both the above cases are unfavorable. The weight ratio is still preferably 10 to 20% by weight.

Examples of the polyolefin include polyethylene, polypropylene and polymethylpentene-1. The polyethylene is particularly preferably a high-density polyethylene having a density of 0.94 g/cm$^3$ or more. Further, the comonomer component is preferably one which maintains the above-described density in an amount of 15% by weight. Polypropylene preferably contains about 85% by weight or more of isotactic polypropylene and may contain about 15% by weight or less of other polypropylene or ethylene, butene or other comonomer component. Further, polymer additives, light stabilizers, lubricants, nucleating agents, crosslinking agents, plasticizers, fillers, etc. may be contained in the polymer.

The apparatus used in the present invention may be provided with a dissolution adjusting apparatus and a spinning device comprising a pressure let-down orifice, a pressure let-down chamber and a spinneret. A device for spreading and dispersing the three-dimensional fiber, a transfer conveyor device and further a winding machine for winding the formed sheet are provided after the spinning device. The sheet forming portion is housed within a sealed box, and the solvent gas within the box is recovered. The solution preparation device may be an autoclave or an extruder. Alternatively, use may be made of a conventional device.

The solvent and solution according to the present invention has a low capability of depleting ozone, and can be used as a novel alternative flon solvent and a solution. Especially, the solvent and solution according to the present invention are very useful as a solvent for flash spinning, a cleaning agent, a foaming material, a gas for the production of a hollow yarn, a reaction solvent, etc. In particular, the solvent and solution according to the present invention are important as a solvent for flash spinning.

A three-dimensional fiber which does not deplete ozone, has a strength and an spreadability comparable or superior to those attained in the case of a use of trichlorofluoromethane and is useful from a social point of view can be prepared through the use of the solvent according to the present invention. The application of the present invention makes it possible to easily prepare, while always maintaining stable productivity, a three-dimensional fiber of a polyolefin having a much superior spreadability and a higher strength than those of a fiber produced by the conventional flash spinning process wherein use is made of a solvent useable as an alternative to trichlorofluoromethane. This industrial significance is incalculably large.

The present invention will now be described in more detail with reference to the following Examples. These Examples are provided only for specifically explaining the present invention, and the present invention is not limited to these Examples only.

EXAMPLES 1

An autoclave was charged with 82.1 g of a high-density polyethylene having a melt index of 0.78 and 613 g of a mixed solvent of bromochloromethane/carbon dioxide (85/15% by weight) (polymer concentration: 11.8% by weight), and the autoclave was heated while rotating a propeller agitator to dissolve the high-density polyethylene. The solution was further heated, and the pressure of the solution was increased to completely dissolve the polymer. After the dissolution, the solution was discharged through a discharge nozzle provided at the bottom of the autoclave to maintain the pressure at about 250 kg/cm$^2$ so that the pressure of the solution does not exceed 300 kg/cm$^2$. When the temperature of the solution reached 200° C., a nitrogen gas introduction valve provided at the top of the autoclave was opened to pressurize the autoclave to 258 kg/cm$^2$. Thereafter, the discharge valve provided at the bottom of the autoclave was quickly opened. Then, the solution was passed through a pressure let-down orifice (diameter: 0.65 mm, length: 5 mm), introduced into a pressure let-down chamber (diameter: 8 mm, length: 40 mm), passed through a spinneret (angle at which the solution is introduced from the pressure let-down chamber into the nozzle: 60°, nozzle diameter: 0.5 mm, length: 0.5 mm, circular grooves having a diameter of 3.3 mmϕ and a depth of 3 mm being provided on the outside with the nozzle as the center) and released in the air. A spread yarn was prepared by striking the yarn against a vinyl chloride inclined about 45° at a position about 20 to 40 mm away from the spinneret. The spread yarn in a spread state was received on a 10-mesh screen for collection. The pressure in the pressure let-down chamber was 174 kg/cm$^2$. The spinning rate was 279 m/sec.

The resultant fiber was a three-dimensional fiber having a good morphology and had, in the form of an unopened state, a fineness of 97 d, a tensile strength of 6.0 g/d, a tensile elongation of 37% and a specific surface area of 24 m$^2$/g and, in the form of a spread state, a fineness of 95 d, a tensile strength of 5.8 g/d and a tensile elongation of 34%.

COMPARATIVE EXAMPLE 1

The procedure of Example 1 was repeated, except that trichlorofluoromethane was used as the solvent and the polymer concentration was 12.5% by weight. The pressure in the pressure let-down chamber was 73 kg/cm$^2$. The spinning rate was 159 m/sec. The resultant fiber had, in the unopened state, a fineness of 99 d, a tensile strength of 5.4 g/d, a tensile elongation of 27% and a specific surface area of 21.2 m$^2$/g.

The spinning rate in Example 1 was 279 m/sec, whereas the spinning rate in Comparative Example 1 was as low as 159 m/sec. This shows that it has become possible to conduct spinning at a much higher rate than that in the case of the conventional process through the use of the solvent according to the present invention. An increase in the spinning rate means that a yarn which can be drawn to a higher degree than that in the case of the conventional process. This can be demonstrated also from the fact that the tensile strength and tensile elongation of the fiber prepared in Comparative Example 1 are inferior to those in Example 1.

EXAMPLES 2 TO 5

The effect of the pressure in the pressure let-down chamber on properties of a spun yarn was examined. The results of spinning are given in Table 1.

The measurement of the number of free fibrils was conducted as follows. Specifically, a sampled spread yarn was gently sandwiched between glass plates, and the number of single yarns in the field were counted while moving an optical microscope (magnification: ×1.6 in objective lens; ×10 in ocular lens) in the direction of fiber width, and calculated in terms of the number of single yarns per 100 d as the number of fibrils.

The spread yarn was prepared by placing a copper plate inclined about 25 mm at a position about 25 mm away from the spinneret and allowing a gas jet containing a fiber to collide against the copper plate.

The spreadability given in the table was evaluated based on the following criteria:

○: The number of free fibrils is 300 fibrils or more per 100 deniers.

Δ: The number of free fibrils is 100 to 300 fibrils per 100 deniers.

X: The number of free fibrils is 100 fibrils or less per 100 deniers.

"X" means that such a fiber cannot be used.

The resultant fibers had a three-dimensional plexifilamentory structure having an excellent spreadability and a high strength.

TABLE 1

| Item | Unit | Ex. 2 | Ex. 3 | Ex. 4 | Ex. 5 |
|---|---|---|---|---|---|
| Pressure in pressure let-down chamber | kg/cm$^2$ | 193 | 181 | 140 | 123 |
| Spinning rate | m/sec | 209 | 263 | 199 | 228 |
| Strength | g/d | 4.1 | 5.0 | 4.5 | 6.3 |
| Elongation | % | 46 | 59 | 53 | 35 |
| Specific surface area | m$^2$/g | 47 | 30 | 28 | 14 |
| Spreadability | — | ○ | ○ | ○ | ○ |

EXAMPLE 6

A fiber having a plexifilamentory structure was produced through the use of a spinning device of Example 1 with the polymer and polymer concentration being fixed and only the solvent composition being varied.

The resultant fiber had a strength of 4.8 g/d and a specific surface area of 36 m$^2$/g when the proportion of bromochloromethane/carbon dioxide was 90.6/9.4% by weight, a strength of 5.2 g/d when the proportion of bromochloromethane/carbon dioxide was 80/20% by weight and a strength of 5.0 g/d when the proportion of bromochloromethane/carbon dioxide was 70/30% by weight. All of these fibers having a plexifilamentory structure had a good spreadability.

EXAMPLES 7

Fibers having a plexifilamentory structure were produced through the use of a spinning device of Example 1 with the polymer and solvent composition being fixed and only the polymer concentration being varied.

The resultant fiber had a strength of 3.4 g/d when the polymer concentration was 7.0% by weight, and a strength of 5.4 g/d when the polymer concentration was 20.5% by weight.

EXAMPLE 8

An autoclave was charged with 81.2 g of a high-density polyethylene having a melt index of 0.78 and 657 g of a mixed solvent of bromochloromethane/HFC-134a (78/22% by weight) (polymer concentration: 11.0% by weight), and the autoclave was heated while rotating a propeller agitator to dissolve the high-density polyethylene. The solution was further heated, and the pressure of the solution was increased to completely dissolve the polymer. After the dissolution, the solution was discharged through a discharge nozzle provided at the bottom of the autoclave to maintain the pressure at about 270 kg/cm$^2$ so that the pressure did not exceed 300 kg/cm$^2$. When the temperature of the solution reached 200° C., a nitrogen gas introduction valve provided at the top of the autoclave was opened to pressurize the autoclave to 270 kg/cm$^2$. Thereafter, the discharge valve provided at the bottom of the autoclave was quickly opened. Then, the solution was passed through a pressure let-down orifice (diameter: 0.65 mm, length: 5 mm), introduced into a pressure let-down chamber (diameter: 8 mm, length: 40 mm), passed through a spinneret (angle at which the solution is introduced from the pressure let-down chamber into the nozzle: 60°, nozzle diameter: 0.5 mm, length: 0.5 mm, circular grooves having a diameter of 4.0 mmϕ and a depth of 3 mm being provided on the outside with the nozzle as the center) and released in the air. A spread yarn was prepared by striking the yarn against a vinyl chloride inclined about 45° at a position about 20 to 40 mm away from the spinneret. The spread yarn in an opened state was received on a 10-mesh screen for collection. The pressure in the pressure let-down chamber was 159 kg/cm$^2$. The spinning rate was 206 m/sec.

The resultant fiber was a three-dimensional fiber having a good morphology and had, in the form of an unopened state, a fineness of 126 d, a tensile strength of 6.6 g/d, a tensile elongation of 36% and a specific surface area of 15 m$^2$/g and, in the form of an opened state, a fineness of 123 d, a tensile strength of 6.5 g/d, a tensile elongation of 20% and a fiber width of 3.5 to 6 cm.

EXAMPLES 9 to 11

The effect of the pressure in the pressure let-down chamber on properties of a spun yarn was examined in the same manner as that of Example 8. The results of spinning are given in Table 2. In this case, the spinneret was changed to one wherein the angle at which the solution is introduced from the pressure let-down chamber into the nozzle was 60°, the nozzle diameter was 0.5 mm, the length was 0.5 mm and circular grooves having a diameter of 3.3 mmϕ and a depth of 3 mm were provided on the outside with the nozzle as the center.

The resultant fibers were a good fiber having a three-dimensional plexifilamentory structure which had an excellent spreadability and a high strength.

TABLE 2

| Item | Unit | Ex. 9 | Ex. 10 | Ex. 11 |
|---|---|---|---|---|
| Pressure in pressure let-down chamber | $kg/cm^2$ | 123 | 167 | 188 |
| Spinning rate | m/sec | 199 | 226 | 225 |
| Strength | g/d | 6.1 | 6.0 | 4.0 |
| Elongation | % | 45 | 37 | 46 |
| Specific surface area | $m^2/g$ | 16 | 24 | 91 |
| spreadability | — | ○ | ○ | ○ |

EXAMPLE 12

Fibers having a plexifilamentory structure were produced through the use of a spinning device of Example 8 with the polymer and polymer concentration being fixed and only the solvent composition being varied.

The resultant fiber had a strength of 4.2 g/d when the proportion of bromochloromethane/HFC-134a was 90/10% by weight, a strength of 5.8 g/d when the proportion of bromochloromethane/HFC-134a was 85/15% by weight and a strength of 5.2 g/d when the proportion of bromochloromethane/HFC-134a was 70/30% by weight. All of these fibers had a good spreadability.

EXAMPLE 13

Fibers having a plexifilamentory structure were produced through the use of a spinning device of Example 8 with the polymer and solvent composition being fixed and only the polymer concentration being varied.

The resultant fiber had a strength of 3.4 g/d when the polymer concentration was 7.2% by weight, and a strength of 5.8 g/d when the polymer concentration was 20.5% by weight.

EXAMPLES 14 to 29

Spinning was conducted through the use of solvents having various solvent compositions in the same manner as that of Example 1. The results are given in Table 3.

TABLE 3

| Item | Unit | | | | | | | | |
|---|---|---|---|---|---|---|---|---|---|
| Ex. | — | 14 | 15 | 16 | 17 | 18 | 19 | 20 | 21 |
| Polymer concentration | wt. % | 14.5 | 14.5 | 14.5 | 14.5 | 15.1 | 14.2 | 10.5 | 10.5 |
| Main solvent | — | DCE | DCE | DCE | DCE | DCE | DCE | BCM | BCM |
| Co-solvent | — | HCFC-22 | HCFC-22 | HFC-134a | HFC-134a | $CO_2$ | $SF_6$ | $SF_6$ | $SF_6$ |
| Amt. of co-solvent | wt. % | 25 | 30 | 25 | 20 | 10 | 15 | 20 | 20 |
| Cloud point pressure | $kg/cm^2$ | 157 | 193 | 235 | 208 | 135 | 128 | — | — |
| Pressure in pressure let-down chamber | $kg/cm^2$ | 135 | 170 | 181 | 180 | 119 | 75 | 165 | 68 |
| Strength | g/d | 5.8 | 5.4 | 7.4 | 6.3 | 6.1 | 5.9 | 7.0 | 5.0 |
| Specific surface area | $m^2/g$ | 42 | 36 | 31 | 38 | 35 | — | — | 15 |
| Spreadibility | — | ○ | ○ | ○ | ○ | ○ | ○ | ○ | ○ |
| Ex. | — | 22 | 23 | 24 | 25 | 26 | 27 | 28 | 29 |
| Polymer concentration | wt. % | 12.5 | 15.3 | 12.0 | 13.0 | 12.0 | 12.0 | 12.0 | 12.0 |
| Main solvent | — | DCE | BCM | DCE | BCM | DCE | BCM | DCE | DCE |
| Co-solvent | — | HCFC-124 | HCFC-124 | HCFC-142b | HCFC-142b | HCFC-225 | HCFC-226 | FC-6112 | FC-7114 |
| Amt. of co-solvent | wt. % | 20 | 25 | 40 | 40 | 55 | 60 | 20 | 20 |
| Cloud point pressure | $kg/cm^2$ | — | — | — | 216 | — | — | 174 | — |
| Pressure in pressure let-down chamber | $kg/cm^2$ | 90 | 123 | 176 | 187 | 91 | 100 | 152 | 136 |
| Strength | g/d | 5.8 | 5.4 | 6.4 | 6.3 | 5.7 | 5.3 | 5.3 | 5.0 |
| Specific surface area | $m^2/g$ | 41 | 39 | 42 | 38 | 35 | 29 | 30 | 29 |
| Spreadability | — | ○ | ○ | ○ | ○ | ○ | ○ | ○ | ○ |

In the table, DCE represents trans-1,2-dichloroethylene and BCM bromochloromethane. HCFC-225 represents a 50/50% by weight mixture of HCFC-225ca/HCFE-225cb.

EXAMPLE 30

An autoclave was charged with 81.7 g of a high-density polyethylene having a melt index of 0.78 and 613 g of a mixed solvent of trans-1,2-dichloroethylene/- bromochloromethane/carbon dioxide (50/35/15% by weight; the proportion of trans-1,2-dichloroethylene/-bromochloromethane in this case being 58.8/41.2% by weight) (polymer concentration: 11.8% by weight), and the autoclave was heated while rotating a propeller agitator to dissolve the high-density polyethylene. The solution was further heated, and the pressure of the solution was increased to completely dissolve the polymer. After the dissolution, the solution was discharged through a discharge nozzle provided at the bottom of the autoclave to maintain the pressure at 200 to 300 kg/cm$^2$ so that the pressure did not exceed 300 kg/cm$^2$. When the temperature (spinning temperature) of the solution reached 200° C., a nitrogen gas introduction valve provided at the top of the autoclave was opened to pressurize the autoclave to 250 kg/cm$^2$. Thereafter, the discharge valve provided at the bottom of the autoclave was quickly opened. Then, the solution was passed through a pressure let-down orifice (diameter: 0.65 mm, length: 5 mm), introduced into a pressure let-down chamber (diameter: 8 mm, length: 40 mm), passed through a spinneret (angle at which the solution is introduced from the pressure let-down chamber into the nozzle: 6°, nozzle diameter: 0.5 mm, length: 0.5 mm, circular grooves having a diameter of 3.3 mmϕ and a depth of 3 mm being provided on the outside with the nozzle as the center) and released in the air. A spread yarn was prepared by striking the yarn against a vinyl chloride inclined about 45° at a position about 20 to 40 mm away from the spinneret. The spread yarn in a spread state was received on a 10-mesh screen for collection.

The resultant fiber had a white color, and was a fiber having a good morphology and had, in the form of an unopened state, a fineness of 84 d, a tensile strength of 6.5 g/d, a tensile elongation of 39% and a specific surface area of 35 m$^2$/g and, in the form of a spread state, a fineness of 85 d, a tensile strength of 6.5 g/d and a tensile elongation of 32%.

The procedure of Example 30 was repeated, except that the spinning temperature was 215° C. As with the fiber prepared in Example 1, the resultant fiber had a white color and similar dynamic properties. When bromochloromethane/carbon dioxide (85/15% by weight) was used as the solvent and the spinning temperature was 215° C., the resultant fiber had a gray color due to the presence of a decomposition product of the solvent although it had dynamic properties similar to the fiber prepared in Example 1.

A combustion test on a mixed gas comprising the solvent and the air was conducted. The solvent described in Example 30 was noncombustible in any mixing ratio thereof to the air. For comparison, the same combustion test was conducted on a composition of 1,2-dichloroethylene/carbon dioxide (85/15% by weight). As a result, when an ignition energy of 1000 mJ or more was applied, combustion occurred in some mixing ratio of the air.

EXAMPLE 31

The procedure of Example 1 was repeated, except that the spinning temperature was raised to 215° C. The resultant fiber was slightly black. Similarly, spinning was conducted after propylene oxide, 1,2-butylene oxide, nitromethane, triphenyl phosphite, dinonylphenyl phosphite, trilauryl phosphite, a diphosphite represented by the structural formula (2) wherein $R^4$ stands for n-$C_{18}H_{37}$ (PEP-8F manufactured by Asahi Denka Kogyo K. K.) or a diphosphite represented by the structural formula (3) wherein $R^5$'s each independently stand for n-$C_{12}H_{25}$, n-$C_{13}H_{27}$, n-$C_{14}H_{29}$ or n-$C_{15}H_{31}$ (MARK-1500 manufactured by Asahi Denka Kogyo K. K.) was added in an amount of 0.1% by weight to the solvent for spinning. No coloring was observed in the yarns prepared through the use of these stabilizers. In particular, with respect to PEP-8F and MARK-1500, no coloring occurred when they were used in an amount of 0.025% by weight.

For comparison, other stabilizers were examined. Specifically, the coloring property was examined in a concentration of 0.1% by weight based on the solvent. As a result of examination of zinc stearate, barium stearate, reethanol, dibutyltin dilaurate, tributylamine, methyl acetate, catechol, etc., no improvement in the coloring property was observed.

EXAMPLES 32 TO 34

Spinning was conducted through the use of isotactic polypropylene instead of the high-density polyethylene. Use was made of polypropylene having a melt flow rate of 1.53 in Example 32 and polypropylene having a melt flow rate of 2.38 in Examples 33 and 34. Spinning was conducted at 215° C., and PEP-8F used in Example 31 was added in an amount of 0.5% by weight based on the solvent. The results are given in Table 4.

TABLE 4

| Item | Unit | | | |
|---|---|---|---|---|
| Ex. | — | 32 | 33 | 34 |
| Polymer concentration | wt. % | 12.0 | 10.5 | 14.5 |
| Main solvent | — | BCM | BCM | DCE |
| Co-solvent | | $CO_2$ | HCFC-134a | HCFC-134a |
| Amt. of co-solvent | wt. % | 15 | 35 | 25 |
| Cloud point pressure | kg/cm$^2$ | — | — | — |
| Pressure in pressure let-down chamber | kg/cm$^2$ | 118 | 95 | 90 |
| Strength | g/d | 2.5 | 4.0 | 3.5 |
| Specific surface area | m$^2$/g | — | 8 | 7 |
| Spreadability | | ○ | ○ | ○ |

COMPARATIVE EXAMPLE 2

The procedure of Examples 1, 14, 16, 19, 22, 28 and 29 was repeated, except that methylene chloride was used as the good solvent. The resultant yarn was in a wet state when use was made of methylene chloride. For example, when conditions of Example 1 were used, the remaining amount of methylene chloride in the yarn as spun was about 16% by weight based on the dried yarn. On the other hand, a dried yarn was obtained in all the Examples of the present invention.

When the polymer concentration was increased to 18% by weight, although a dried yarn could be obtained, the openability was Δ to X according to the evaluation method in Table 1. For example, when use was made of conditions of Example 1, the number of free fibrils was 130. Incidentally, the number of fibrils in Example 1 was 310.

The solvent used in Examples 14 and 15 was recovered and repeatedly used in the same experiment. As a result, the proportion of the trans isomer in 1,2-dichloroethylene gradually decreased as the number of repetitions increased, and the proportion of the trans isomer became constant in a range of 30 to 40% by weight. The procedure of Examples 14 and 15 was repeated through the use of 1,2-dichloroethylene wherein the proportion of trans isomer/cis isomer was 35/65% by weight. As a result, substantially no change in the trans isomer/cis isomer was observed.

EXAMPLE 35

Example 35 demonstrates an example wherein the present invention was applied to an application other than flash spinning, that is, the results of use of the solvent of the present invention for the production of a regenerated cellulose polymer membrane having an enhanced affinity for blood.

0.32 g of $C_{12}H_{25}(OCH_2CH_2)_nOCH_2COOH$ wherein n is 4.5 on the average, 0.01 g of 4,4-dimethylaminopyridine and 0.13 g of dicyclohexylcarbodiimide were dissolved in 350 $cm^3$ of bromochloromethane/HFC-134a (85/15% by weight). A bundle of a regenerated cellulose hollow yarn membrane (inner diameter: 0.2 mm, membrane thickness: 0.013 mm, length: 30 cm) (number of hollow yarn membranes: 7000) was shaken in the resultant treating solution for 30 min while often moving the bundle up and down. The treated regenerated cellulose hollow yarn membrane was immersed in methanol for 24 hr and vacu dried at room temperature to give a bundle of a hollow yarn membrane (1) wherein the surface of the hollow yarn had been esterified.

For comparison, 1,1,2-trichloro-1,2,2-trifluoroethane/acetone (87.5/12.5% by weight) which is used on a commercial scale and contains a particular flon was used instead of bromochloromethane/HFC-134a (85/15% by weight). The esterified hollow yarn membrane bundle thus prepared is designated as a hollow yarn membrane bundle (2).

The resultant esterified regenerated cellulose hollow yarn membranes (1) and (2) and an untreated regenerated cellulose hollow yarn membrane (3) were each integrated into a dialyzer, and extracorporeal circulation of blood of a dog was conducted. The dog used was a beagle having a weight of 10 kg. The blood was collected at rate of 100 $cm^3$/min from a shunt provided on a cervical part and flowed into the dialyzer. Prior to the extracorporeal circulation, the dialyzer was washed with a physiological salt solution. The dialyzer and blood circuit were filled with a physiological salt solution containing 5U/$cm^3$ of heparin, and the blood was then flowed. The blood was sampled at the inlet of the dialyzer and subjected to measurement of leukocyte count. The leukocyte counts 15 min after the dialysis and 30 min after the dialysis when the leukocyte count immediately before the dialysis was taken as 100 are given in Table 5.

TABLE 5

| Hollow fiber membrane | 15-min value | 30-min value |
|---|---|---|
| (1) | 75 | 84 |
| (2) | 73 | 82 |
| (3) | 13 | 44 |

It is apparent that the use of the solvent of the present invention can provide a regenerated cellulose hollow yarn membrane having an affinity for blood comparable or superior to a solvent comprising 1,1,2-trichloro-1,2,2-trifluoroethane and acetone.

We claim:

1. A process for producing a three-dimensional fiber of a polyolefin, comprising passing a polyolefin solution prepared under high temperature and high pressure conditions through a pressure let-down orifice, a pressure let-down chamber and a spinneret into a region where the temperature and pressure are room temperature and atmospheric pressure, respectively, to prepare a fibrilated, three-dimensional fiber of a polyolefin, wherein a mixed solvent consisting essentially of at least one solvent bromochloromethane or 1,2-dichloroethylene, and a co-solvent are used as a mixed solvent, wherein said co-solvent being at least carbon dioxide, sulfur hexafluoride, difluorochloromethane, 1,1,1,2-tetrafluoroethane, 1-chloro-1,2,2,2-tetrafluoroethane, 1-chloro-1,1-difluoroethane, 1,1 -dichloro-2,2,3,3,3-pentafluoropropane, 1,3-dichloro-1,2,2,3,3-pentafluoropropane, dodecafluoropentane or tetradecafluorohexane, the content of said co-solvent in the mixed solvent being 3 to 65% by weight, and the concentration of a polyolefin in said polyolefin solution is 5 to 25% by weight.

2. A process for producing a three-dimensional fiber of a polyolefin, according to claim 1, wherein said solvent is a two-component solvent comprised of bromochloromethane and 1,2-dichloroethylene and a co-solvent is used as a solvent, and the content of bromochloromethane in the two-component solvent is 40 to 75% by weight.

3. A process for producing a three-dimensional fiber of a polyolefin according to claim 1 or 2, wherein the proportion of the co-solvent in the mixed solvent is 10 to 30% by weight.

4. A process for producing a three-dimensional fiber of a polyolefin according to claim 1, wherein 0.001 to 5% by weight, based on the mixed solvent, of at least one stabilizer wherein said stabilized is propylene oxide, 1,2-butylene oxide, nitromethane, a phosphite represented by the following structural formula (1), a diphosphite represented by the following structural formula (2) or a diphosphite represented by the structural formula (3) is contained in said mixed solvent

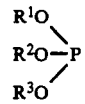
(1)

wherein $R^1$, $R^2$ and $R^3$ which may the same or different each stand for a monovalent hydrocarbon group having 1 to 30 carbon atoms;

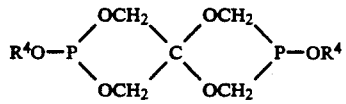
(2)

wherein $R^4$ stands for a monovalent hydrocarbon group having 8 to 30 carbon atoms;

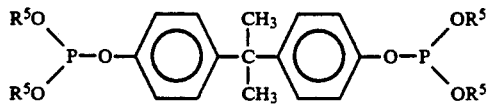
(3)

wherein $R^5$ stands for a monovalent hydrocarbon group having 8 to 30 carbon atoms.

5. A process for producing a three-dimensional fiber of a polyolefin according to claim 1, wherein the proportion of the trans isomer in 1,2-dichloroethylene is 30 to 40% by weight.

6. A process for producing a three-dimensional fiber of a polyolefin, according to claim 1, wherein a mixed solvent consisting essentially of 80 to 90% by weight of bromochloromethane and 20 to 10% by weight of carbon dioxide is used as a solvent and the polyolefin concentration of said solution is 10 to 20% by weight.

7. A process for producing three-dimensional fiber of a polyolefin, according to claim 1, wherein a mixed solvent consisting essentially of 75 to 85% by weight of bromochloromethane and 25 to 15% by weight of 1,1,1,2-tetrafluoroethane is used as a solvent and the polyolefin concentration of said solution is 10 to 20% by weight.

8. A process for producing a three-dimensional fiber of a polyolefin according to claim 1, wherein said polyolefin is polyethylene.

9. A process for producing a three-dimensional fiber of a polyolefin according to claim 1, wherein said polyolefin is polypropylene.

* * * * *

UNITED STATES PATENT AND TRADEMARK OFFICE

CERTIFICATE OF CORRECTION

PATENT NO. : 5,286,422

DATED : February 15, 1994

INVENTOR(S) : Kato et al.

It is certified that error appears in the above-indentified patent and that said Letters Patent is hereby corrected as shown below:

Claim 4, col. 26, line 35, "stabilized" should be --stabilizer--
line 47, after "may" insert --be--.

Signed and Sealed this

Twenty-sixth Day of July, 1994

Bruce Lehman

*Attest:*

BRUCE LEHMAN

*Attesting Officer*

*Commissioner of Patents and Trademarks*